US005711364A

United States Patent [19]

Ota et al.

[11] Patent Number: 5,711,364

[45] Date of Patent: Jan. 27, 1998

[54] METHOD OF AND APPARATUS FOR CASTING PIPE

[75] Inventors: Atsushi Ota, Toyota; Masatada Nakamichi, Okazaki; Hidehiko Kadono, Toyota; Seizi Uda, Okazaki; Hiroaki Mori; Shinichi Yoshida, both of Toyota, all of Japan

[73] Assignee: Toyota Jidosha Kabushiki Kaisha, Toyota, Japan

[21] Appl. No.: 696,059

[22] Filed: Aug. 13, 1996

[30] Foreign Application Priority Data

Aug. 30, 1995 [JP] Japan ..... 7-221945

[51] Int. Cl.[6] ..... B22D 17/08

[52] U.S. Cl. ..... 164/113; 164/137; 164/312; 164/340; 164/120

[58] Field of Search ..... 164/340, 369, 164/137, 133, 302, 351, 365, 366, 367, 368, 397, 398, 399, 400, 120, 319, 320, 112, 113, 312

[56] References Cited

U.S. PATENT DOCUMENTS

| | | | |
|---|---|---|---|
| 3,991,811 | 11/1976 | Diez et al. | 164/340 |
| 4,240,498 | 12/1980 | Frenette . | |

FOREIGN PATENT DOCUMENTS

| | | |
|---|---|---|
| B-314 111 | 3/1974 | Austria . |
| 662360-A1 | 7/1995 | European Pat. Off. . |
| U-9413450 | 10/1994 | Germany . |
| A-61-1461 | 1/1986 | Japan . |
| A-61-9959 | 1/1986 | Japan . |
| A-7-227666 | 8/1995 | Japan . |

*Primary Examiner*—Kuang Y. Lin

*Attorney, Agent, or Firm*—Oliff & Berridge, P.L.C.

[57] ABSTRACT

A method of casting a pipe having an axially elongate hole of which a front end is closed, comprises the steps of positioning a rod-like center pin for forming the blind hole in a predetermined positional relation to cavity defining surfaces of a die cavity, supporting the positioned center pin sidewise with a support pin to prevent positional deviation of the center pin, charging molten metal into the die cavity, retreating the support pin apart from the center pin, and replenishing a space formed by the retreat of the support pin with molten metal.

1 Claim, 9 Drawing Sheets

METHOD OF AND APPARATUS FOR CASTING PIPE

BACKGROUND OF THE INVENTION

1. Field of the Invention

This invention relates to a method of and apparatus for casting a pipe having an axially elongate hole of which a front end is closed.

2. Description of the Prior Art

The inventors have long been conducting researches and investigations concerning the pertinent technique, and they proposed a newest result in Japanese Patent Application No. 6-286562 (corresponding to U.S. patent application No. 08/357,184). The above application has not been laid open on the priority date of this application. The newest technique is shown in the fragmentary sectional views of FIGS. 10(A) and 10(B).

The pipe casting apparatus shown in FIGS. 10(A) and 10(B), is for casting a fuel delivery pipe which is mounted on an engine. The apparatus 1 has a die 2 defining a cavity 3, in which a center pin 4 for forming an axially elongate hole is set such that it is positioned in the longitudinal direction. Four movable mandrel pins 5 for forming injector mounting holes are held in radial (i.e., sidewise) contact with the center pin 4 on one side thereof. A stationary core pin 7 for forming a pressure regulator mounting hole is held in contact with the center pin 4 on the side thereof opposite the movable mandrel pins 5.

The center pin 4 has its stem portion 4*a* cantilever supported in the die 2 such that its free end 4*b* is found in the cavity, so that it forms a blind hole in the cast product. A front end of the hole in a cast product is closed. In other words, the center pin 4 cannot be supported by two-point support in the die 2 because of its purpose of forming a blind hole closed at the front end. In place of two-point support, its free end 4*b* is supported such that it is radially clamped between one movable mandrel pin 5 and the stationary core pin 7. Its intermediate portions are supported radially on one side by the other movable mandrel pins 5. Thus, despite its cantilever support, the center pin 4 is not deviated in position or deformed by the impact exerted to the center pin 4 by pressure pouring of molten metal under high pressure into the cavity 3. The fuel passage (i.e., blind hole) in the fuel delivery pipe thus can be formed with high accuracy.

In the above pipe casting apparatus 1, however, the center pin 4 is supported by the movable mandrel pins 5 and stationary core pin 7. In the case of forming a fuel delivery pipe without any pressure regulator mounting hole, where the stationary core pin 7 is not used, the free end 4*b* of the center pin 4 can no longer be radially clamped between the two pins 5 and 7.

SUMMARY OF THE INVENTION

An object of the invention is to permit satisfactory support of the center pin even in the case of a pipe having no hole crossing an axial blind hole.

One aspect of the invention features a method of casting a pipe having an axially elongate hole of which a front end is closed, which comprises the steps of positioning a rod-like center pin for forming the blind hole in a cavity of a die in a predetermined positional relation thereto such that a stem portion of the center pin is cantilever supported in the die and the free end of the center pin is found in the cavity, supporting the positioned center pin sidewise with a support pin to prevent positional deviation of the center pin, charging molten metal into the die cavity, retreating the support pin apart from the center pin, and replenishing a space formed by the retreat of the support pin with molten metal.

According to the invention, the center pin is supported sidewise by the support pin in the cavity when molten metal is poured thereinto. The center pin thus is not deviated or deformed by shocks exerted thereto with the charging of molten metal. It is thus possible to form the blind hole with high accuracy. Once molten metal has been charged into the cavity, no shock due to molten metal is exerted to the center pin, so that deviation or the like of the center pin is not caused even if the support pin is separated from the center pin. Thus, the support pin is separated from the center pin after the charging of molten metal, and the space formed as a result of the separation of the support pin from the center pin is replenished with molten metal and is thus closed. In this way, it is possible even in the case of a pipe having no hole crossing an axial blind hole to charge molten metal with the center pin supported satisfactorily with the support pin and form no sidewise hole open to the closed end portion of the blind hole.

Another aspect of the invention features an apparatus for casting a pipe having an axially elongate hole closed at one end, which comprises a rod-like center pin for forming the blind hole, the center pin being positioned in a cavity of a die in a predetermined positional relation thereto such that a stem portion of the center pin is cantilever supported in the die and the free end of the center pin is found in the cavity, a support pin for supporting the center pin sidewise to prevent positional deviation of the center pin, a support pin retreating mechanism for retreating the support pin apart from the center pin by a predetermined distance after the die cavity has been filled with molten metal, and a molten metal replenishing mechanism for replenishing with molten metal a space formed as a result of the retreat of the support pin by the support pin retreating mechanism after the cavity has been filled with molten metal.

With this apparatus, molten metal is charged into the die cavity with the center pin held supported sidewise by the support pin, so that a blind hole can be formed with high accuracy without possibility of deviation or the like of the center pin which may otherwise be caused due to shocks exerted thereto during pressure charging of molten metal. In addition, the support pin is retreated apart from the center pin by the support pin retreating mechanism in the state that the cavity is filled with molten metal and also the space formed by the retreat of the support pin is replenished with molten metal by the molten metal replenishing mechanism, so that the hole that has initially been formed by the support pin is closed.

The molten metal replenishing mechanism can be adapted to replenish the space formed by the retreat of the support pin with molten metal by pressurizing the molten metal in the cavity with a pressurizing pin. In this mode of operation, no molten metal has to be replenished through a gate, and it is thus possible to obtain efficient replenishment of the space formed by the retreat of the support pin with molten metal even where the support pin and the gate are spaced apart a large distance.

In this case, the support pin and the pressurizing pin are preferably interlocked to each other.

This mode of operation requires only single set of means for driving the support pin and the pressurizing pin, and thus permits reduction of the installation cost. In addition, the pressurizing pin is pushed into the cavity simultaneously with the retreat of the support pin, thus ensuring smooth replenishment with molten metal.

Preferably, the cavity has a-molten metal flow groove extending from the position corresponding to the support pin to the gate as the molten metal supply part. This arrangement permits readier flow of molten metal from the gate to the position corresponding to the support pin, and the space formed by the retreat of the support pin can be efficiently replenished with molten metal through the gate. Efficient replenishment of molten metal is thus obtainable even in the case where it is impossible to provide a gate near the support pin.

The present invention will be more fully understood from the following detailed description and appended claims when taken with the accompanying drawings.

DETAILED DESCRIPTION OF THE PREFERRED EMBODIMENTS

First Embodiment

Figure 1A:
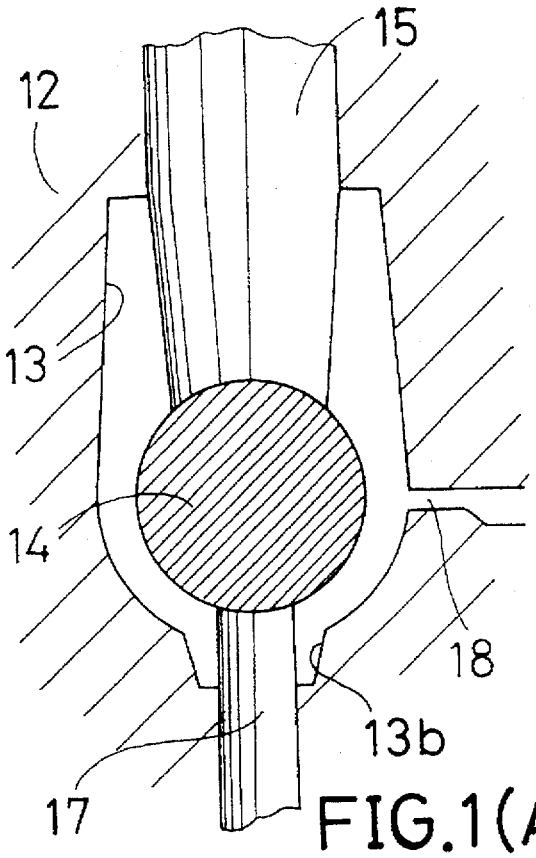
FIGS. 1(A) to 1(C) are sectional views illustrating various steps in a pipe casting method according to a first embodiment of the invention.
Figure 1B:
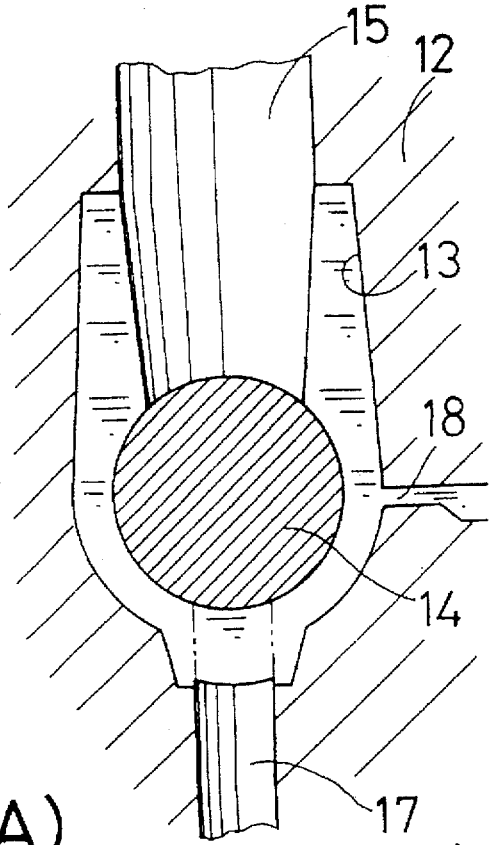
Figure 1C:
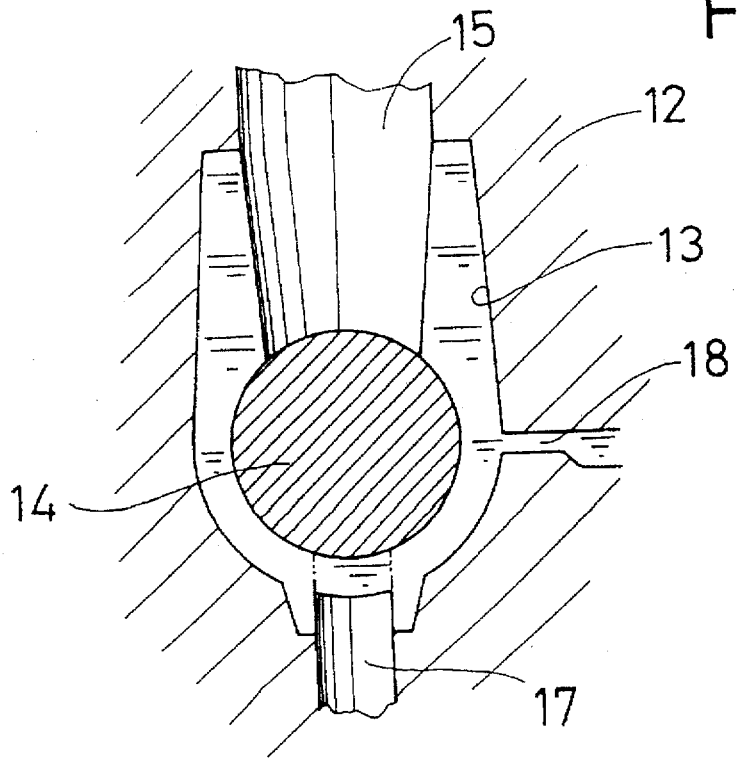
Figure 2B:
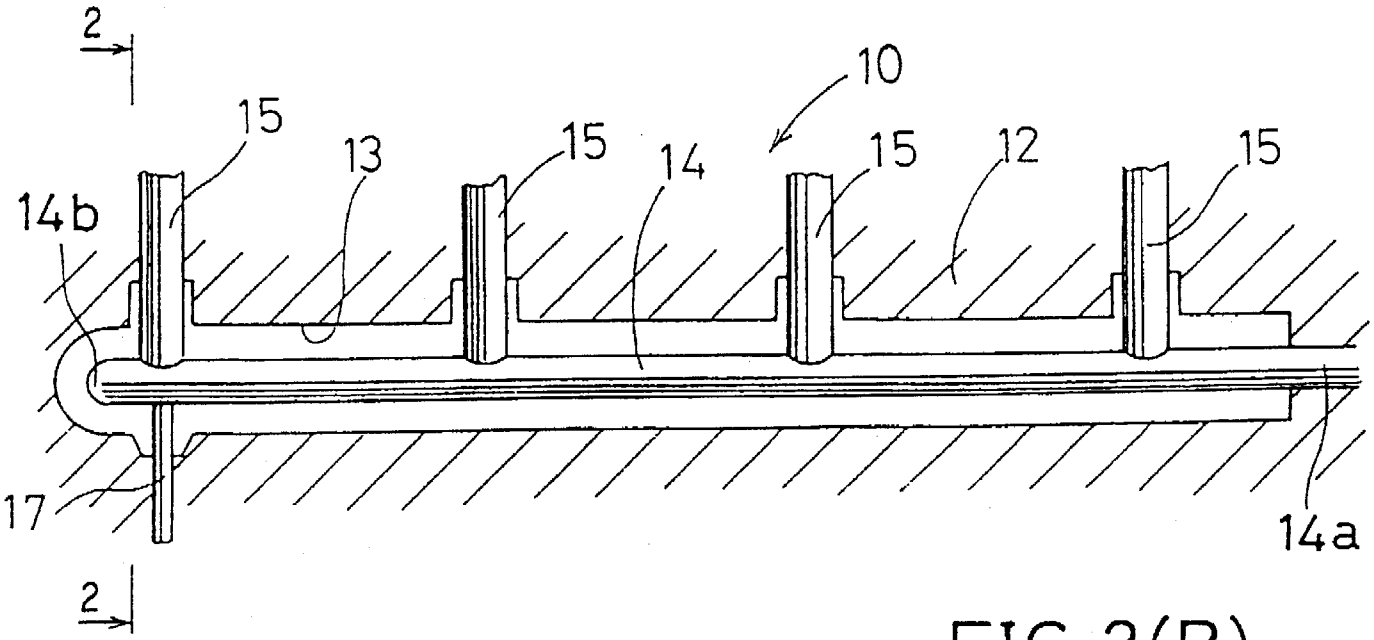
FIGS. 2(A) and 2(B) are fragmentary sectional views showing a pipe casting apparatus according to the first embodiment of the invention.
Figure 2A:
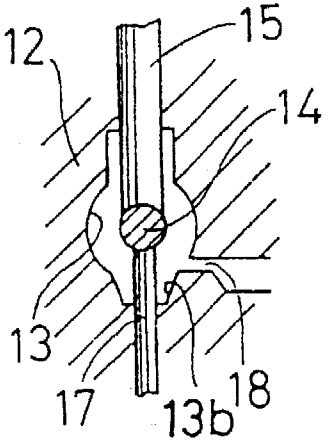
Figure 3:
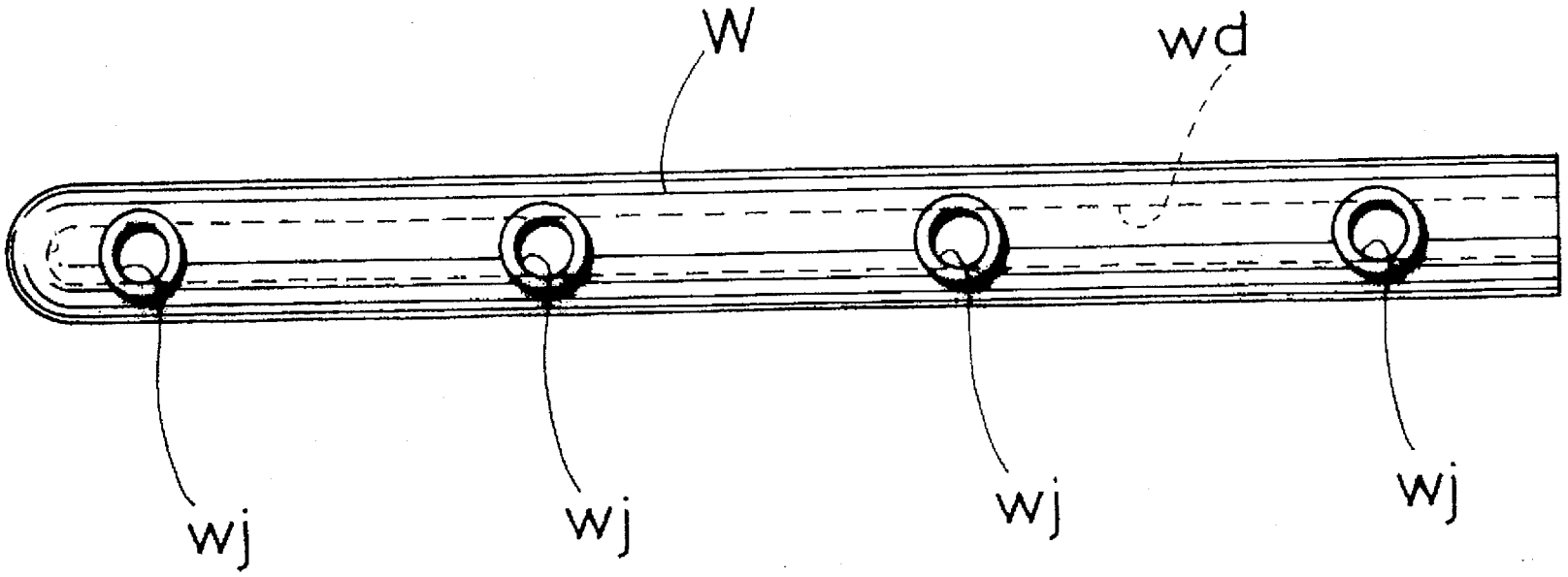
FIG. 3 is a plan view showing a pipe product produced with the pipe casting apparatus according to the first embodiment of the invention.

A method of and an apparatus for pipe casting according to a first embodiment of the invention will now be described with reference to FIGS. 1(A) to 1(C), 2(A), 2(B) and 3. FIGS. 1(A) to 1(C) are sectional views showing successive steps in the pipe casting method. FIGS. 2(A) and 2(B) are fragmentary sectional views showing the pipe casting apparatus. FIG. 3 is a plan view showing a pipe product W obtained by the casting.

The pipe product W obtained by the casting in the pipe casting method according to this embodiment, is a fuel delivery pipe for supplying fuel to an engine. As shown in FIG. 3, the pipe product W has an axial fuel passage wd having an inner closed end we. The axial fuel passage wd is an axial blind hole closed at the inner end. The pipe product W also has four injector mounting holes wj for mounting injectors therein, the injector mounting holes wj communicating with the fuel passage wd.

As shown in FIGS. 2(A) and 2(B), the pipe casting apparatus 10 for forming the delivery pipe w comprises a die 12. When the die 12 is closed, a cavity 13 is defined therein for forming the outer shape of the delivery pipe W. A center pin 14 for forming the fuel passage wd is positioned in the cavity. The center pin 14 extends longitudinally of the cavity in a predetermined positional relation to cavity defining surfaces. The center pin 14 is positioned such that its stem portion 14*a* is cantilever supported in the die 12 and that its free end 14*b* is found in the cavity 14. Four movable mandrel pins 15 for forming the respective injector mounting holes wj are held in contact with the center pin 14 radially (i.e., sidewise) on one side thereof. A counter support pin 17 is held in contact with the center pin 14 at a position thereof corresponding to the movable core pin 15 adjacent the free end 14*b* of the center pin 14 on the side thereof opposite that movable mandrel pin 15. The free end 14*b* of the center pin 14 is thus held radially clamped between the movable mandrel pin 15 noted above and the counter support pin 17. The center pin 14 supported in this way, thus is not deviated or bent by shocks exerted by the flow of molten metal charged into the cavity 13. The movable core pins 15 and counter support pin 17 serve as support pins according to the invention.

A gate 18 through which molten metal is poured into the cavity 13, is provided near a boss space 13*b* of the cavity 13 for the counter support pin 17. (see FIG. 2(A)).

After molten metal has been charged into the cavity 13, that is, when no shock due to molten metal flow is exerted to the center pin 14 any more, the counter support pin 17 can be retreated from its position shown in FIGS. 2(A) and 2(B) to the cavity defining surface position by the action of a support pin retreating mechanism (not shown). After the lapse of a predetermined period of time, the counter support pin 17 having been retreated to the cavity defining surface position, is advanced again into the cavity 13 to locally pressurize molten metal.

The timing of the charging of molten metal into the cavity 13 and the timing of the local pressurization of the molten metal, are suitably determined according to the variable molten metal pressure which is measured by a pressure sensor (not shown) mounted on the counter support pin 17. As an alternative method, the timings of the charging of molten metal and the local pressurization thereof may be determined by using a timer with reference to the instant of the end of the charging of molten metal. When locally pressurizing molten metal, the pressurizing stroke of the counter support pin 17 can be controlled for it is necessary to compensate for product wall thickness variations.

Now, the method of pipe casting according to this embodiment will be described with reference to FIG. 1(A) to 1(C).

First, the die 12 is closed to position the center pin 14 for forming the fuel passage wd in a predetermined positional relation to the cavity defining surfaces. At this time, the four movable mandrel pins 15 for forming the respective injector mounting holes wj are held in contact with the positioned center pin 14 radially on one side thereof. The counter support pin 17 is further held in contact with the center pin 14 radially on the side thereof opposite the movable mandrel pins 15. The free end 14*b* of the center pin 14 is thus held clamped radially between the movable mandrel pin 15 and counter support pin 17 as shown in FIG. 1(A).

When the die 12 has been closed in this way, molten metal is poured form a sleeve (not shown) through the gate 18 into the cavity 13. The completion of charging of molten metal into the cavity 13 is detected by a pressure sensor mounted on the counter support pin 17. As this occurs, the counter support pin 17 is retreated from its position in contact with the center pin 14 to the cavity defining surface position as shown in FIG. 1(B). As a result, molten metal is supplied through the gate 18 to the space formed by the retreat of the counter support pin 17, thus closing the hole that has been formed by the counter support pin 17. Since the gate 18 is provided near the counter support pin 17, molten metal is supplied smoothly through the gate 18 to the space noted above. The sleeve and gate 18 noted above constitute a molten metal replenishing mechanism according to the invention.

As shown in FIG. 1(C), after the retreat of the counter support pin 17, the counter support pin 17 is advanced to locally pressurize the molten metal in the cavity 13 when a predetermined value is measured by the pressure sensor mounted on the counter support pin 17. When the solidification of the molten metal in the cavity 13 is completed after the lapse of a predetermined period of time, the die 12 is opened, and the delivery pipe w thus formed is taken out from the die 12. From the delivery pipe w thus taken out, the center pin 14 and the-movable mandrel pins 15 are taken out, thus obtaining the pipe with the axial blind hole and holes extending across the blind hole.

As shown above, with the pipe casting method according to this embodiment, the free end of the center pin 14 is supported such that it is radially clamped between the movable mandrel pin 15 and counter support pin 17 when molten metal is poured into the cavity 13, so that the center pin 14 is neither bent nor deviated irrespective of application of shocks to the center pin 14 due to the flow of molten metal. It is thus possible to form the fuel passage wd with high accuracy. In addition, the center pin 14 is not deviated when the counter support pin 17 is retreated apart from the center pin 14, because the retreat of the counter support pin 17 is caused after the charging of molten metal into the cavity 14, that is, when no shock due to molten metal flow is exerted to the center pin 14 any more.

Since the space formed by the retreat of the counter support pin 17 apart from the center pin 14 is replenished with molten metal through the gate 18, the hole that has initially been formed by the counter support pin 17 is closed. This means that it is possible to support the center pin 14 by using the counter support pin 17 even in the case of a delivery pipe w without any hole crossing the axial blind hole.

The space that is formed by the retreat of the counter support pin 17 contains no air, that is, no air is trapped in the molten metal supplied to this space. Moreover, since the molten metal supplied to the space formed by the retreat of the counter support pin 17 is locally pressurized by the counter support pin 17 while it is solidified, the quality of this portion of the pipe is improved.

Second Embodiment

Figure 4B:
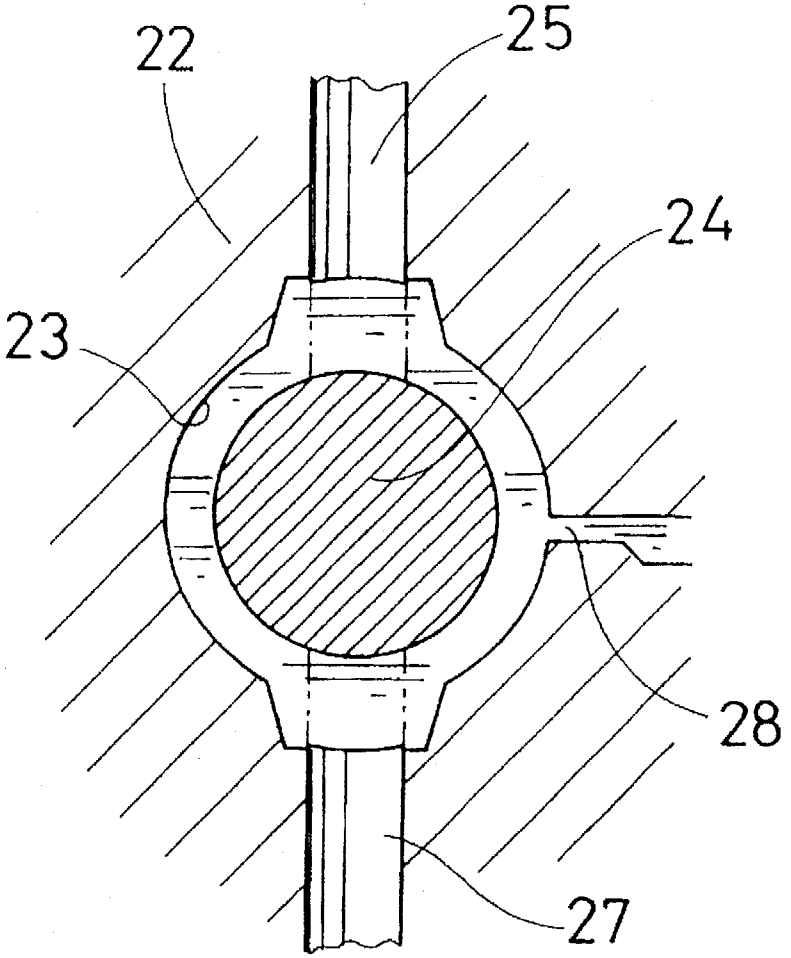
FIGS. 4(A) and 4(B) are fragmentary sectional views showing a pipe casting apparatus according to a second embodiment of the invention.
Figure 4A:
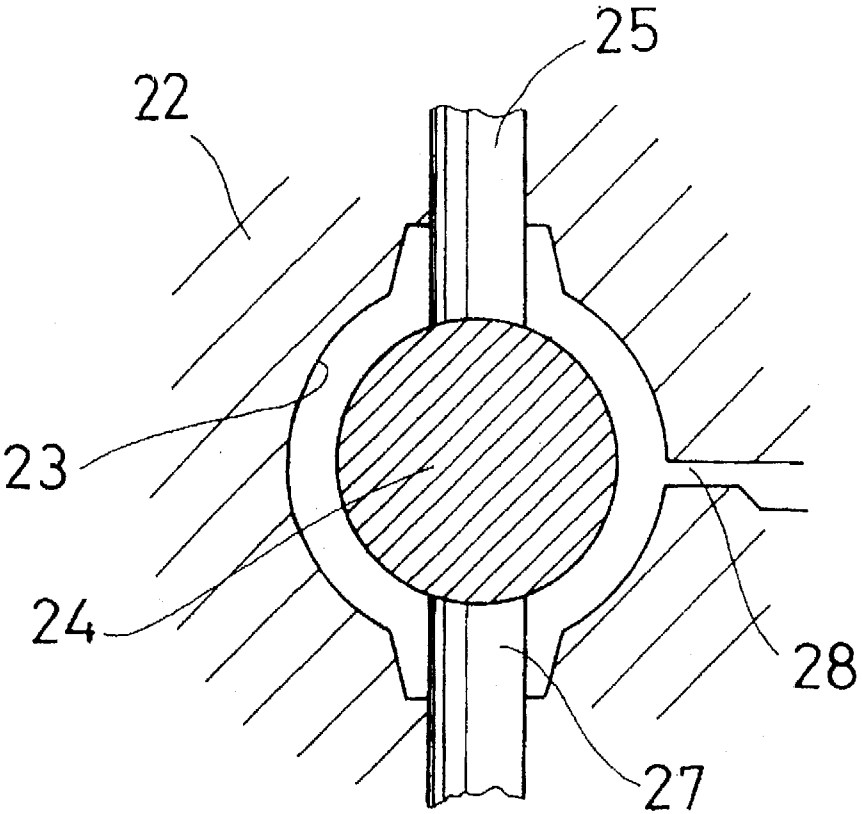

FIGS. 4(A) and 4(B) are sectional views showing a pipe casting apparatus according to a second embodiment of the invention.

In the pipe casting apparatus according to this embodiment, as shown in FIG. 4(A), the free end of a center pin 24 can be supported such that it is radially clamped between two counter support pins 25 and 27.

In this pipe casting apparatus, with the closing of a die 22, a center pin 24 for forming the fuel passage w is positioned in a predetermined positional relation to the cavity defining surfaces. At this time, movable mandrel pins (not shown) for forming injector mounting pins wj are held in contact with the positioned center pin 24 radially on one side thereof, while also the free end of the center pin 24 is clamped radially between the two counter support pins 25 and 27, as shown in FIG. 4(A).

When the closing of the die 22 is completed, molten metal is injected from a sleeve (not shown) and poured through a gate 28 into a cavity 23. After the lapse of a predetermined period of time from the end of the charging of molten metal into the cavity 23 so that the center pin 24 is no longer vibrated, the counter support pins 25 and 27 are retreated from their position in contact with the center pin 24 to the cavity defining surface position as shown in FIG. 4(B). With the retreat of the counter support pins 25 and 27, spaces are formed, and molten metal is supplied thereto through the gate 28, thus closing the holes having been formed by the two counter support pins 25 and 27. Thus, the center pin 24 can be reliably supported by using the counter support pins 25 and 27 even in the case of a delivery pipe w without any hole crossing the axial blind hole at the closed end thereof.

Third Embodiment

Figure 5:
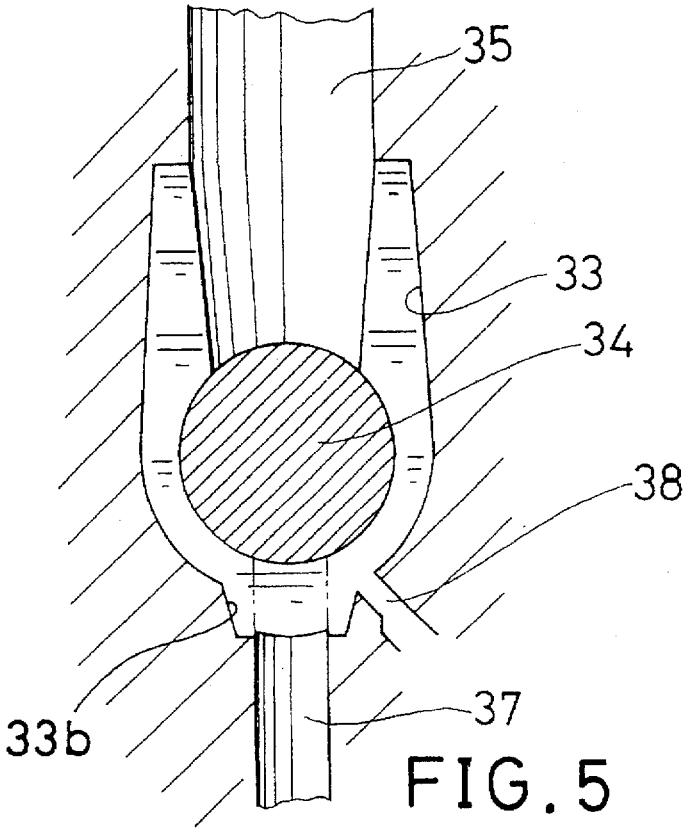
FIG. 5 is a fragmentary sectional view showing a pipe casting apparatus according to a third embodiment of the invention.

FIG. 5 is a sectional view showing a pipe casting apparatus according to a third embodiment of the invention.

In the pipe casting apparatus according to this embodiment, a cavity 33 has a gate 38 which is provided in the close vicinity of a boss space **33*b* for the counter support pin. Molten metal is thus supplied efficiently through the gate 38 to the space formed as a result of retreat of the counter support pin 37. Thus, molten metal is supplied reliably to that space even when molten metal near the counter support pin 37** is solidified.

Fourth Embodiment

Figure 6:
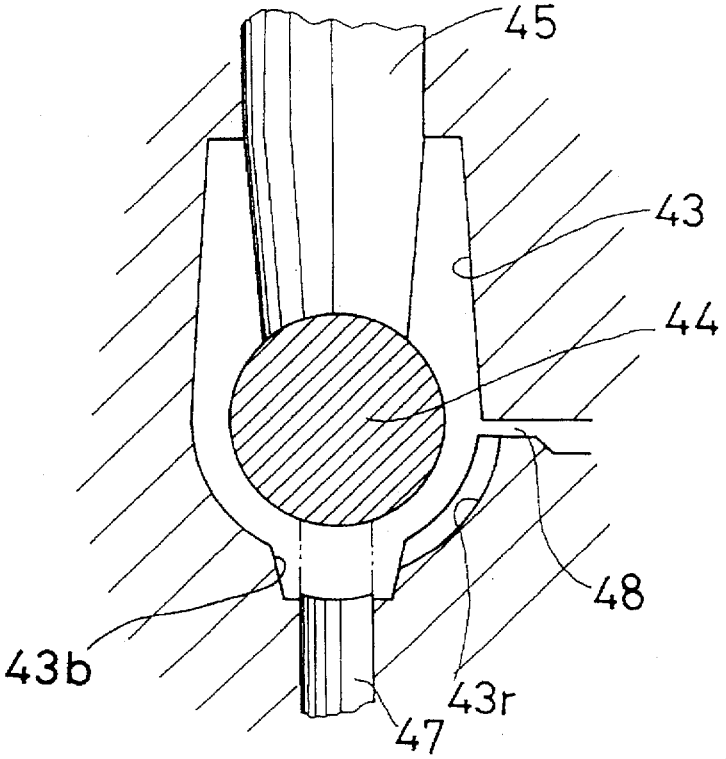
FIG. 6 is a fragmentary sectional view showing a pipe casting apparatus according to a fourth embodiment of the invention.

FIG. 6 is a sectional view showing a pipe casting apparatus according to a fourth embodiment of the invention.

In the pipe casting apparatus according to this embodiment, a cavity 43 is formed with a molten metal flow groove **43*r* extending between a boss space 43*b* for the counter support pin and a gate 48. Molten metal thus can be supplied efficiently through the gate 48 to the space formed by the retreat of the counter support pin 47 even in the case where it is impossible to provide the gate 48 in the close vicinity of the counter support pin boss space 43*b***.

Fifth Embodiment

Figure 7B:
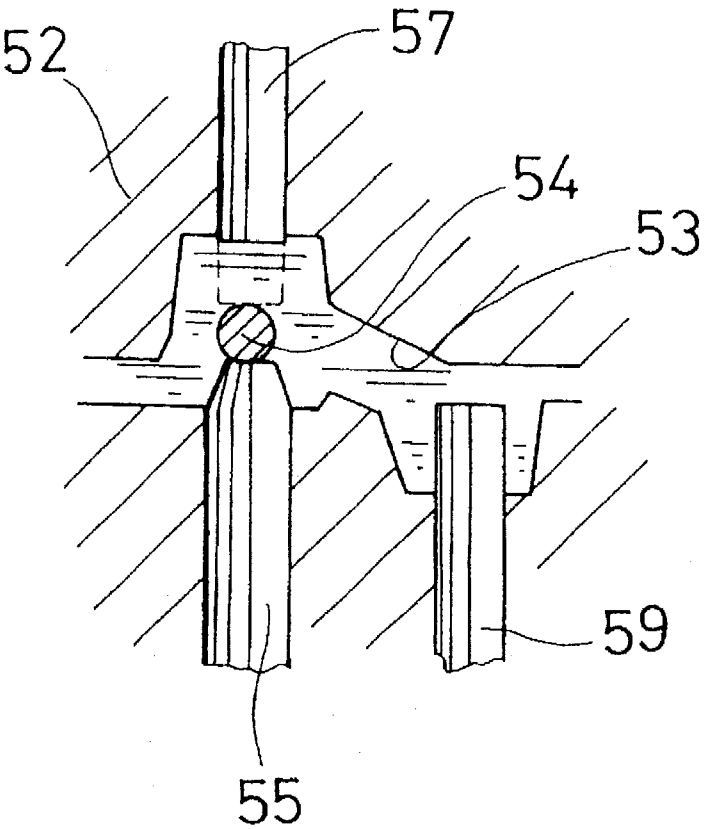
FIGS. 7(A) and 7(B) are fragmentary sectional views showing a pipe casting apparatus according to a fifth embodiment of the invention.
Figure 7A:
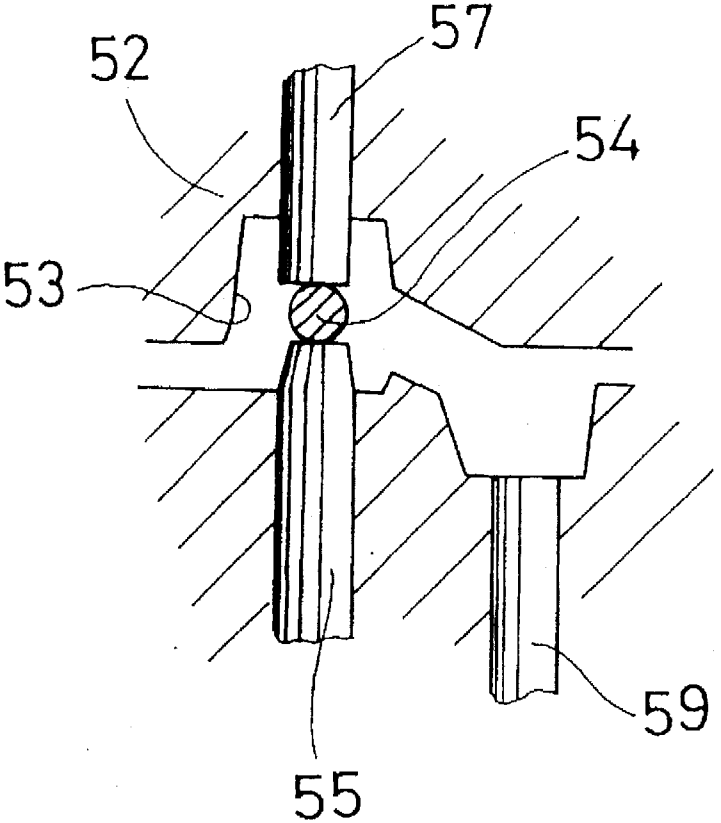

FIGS. 7(A) and 7(B) are sectional views showing a pipe casting apparatus according to a fifth embodiment of the invention.

In the pipe casting apparatus according to this embodiment, molten metal can be supplied by a pressurizing pin 59 to the space formed by the retreat of the counter support pin 57.

In this pipe casting apparatus, with the closing of a die 52, a center pin 54 for forming a fuel passage wd is positioned in a predetermined positional relation to the cavity defining surfaces. At this time, movable mandrel pins 55 for forming an injector mounting pin wj are held in contact with the positioned center pin 54 radially on one side thereof. Also, a counter support pin 57 is held in contact with a free end portion of the center pin 54 on the side thereof opposite a corresponding one of the movable mandrel pins 55. The free end portion of the center pin 54 is thus supported such that it is held clamped radially between the movable mandrel pin 55 and the counter support pin 57, as shown in FIG. 7(A).

When the die 52 has been closed, molten metal is injected from a sleeve (not shown) and poured through a gate into a cavity 53. When molten metal has been charged into the cavity 53, the counter support pin 57 is retreated from its position in contact with the center pin 54 to the cavity defining surface position as shown in FIG. 7(B). Substantially simultaneously with the retreat of the counter support pin 57, a pressurizing pin 59 is pushed into the cavity 56 to pressurize molten metal. The molten metal is thus supplied to the space formed by the retreat of the counter support pin 57.

Thus, with the method of pipe casting according to this embodiment, molten metal need not be supplied through the gate to the space noted above. Molten metal thus can be efficiently supplied to the space formed by the removal of the counter support pin 57 even in the case where the counter support pin 57 and the gate are spaced apart a great distance. The method is thus effective even in the case where it is impossible in terms of the equipment aspect to provide the gate near the counter support pin 57.

Sixth Embodiment

Figure 8B:
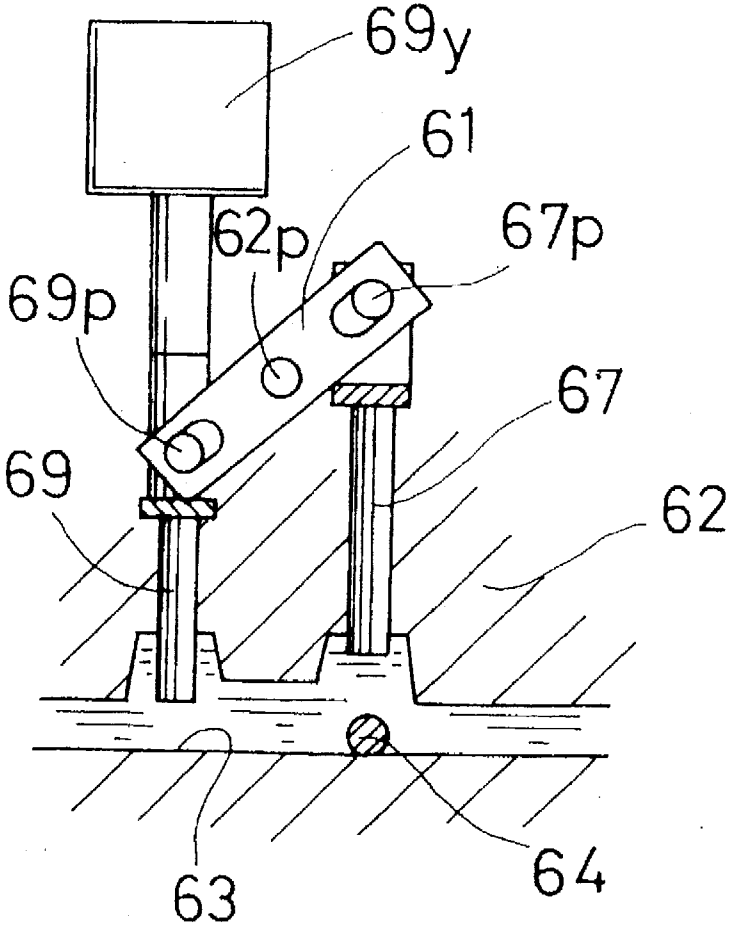
FIGS. 8(A) and 8(B) are fragmentary sectional views showing a pipe casting apparatus according to a sixth embodiment of the invention.
Figure 8A:
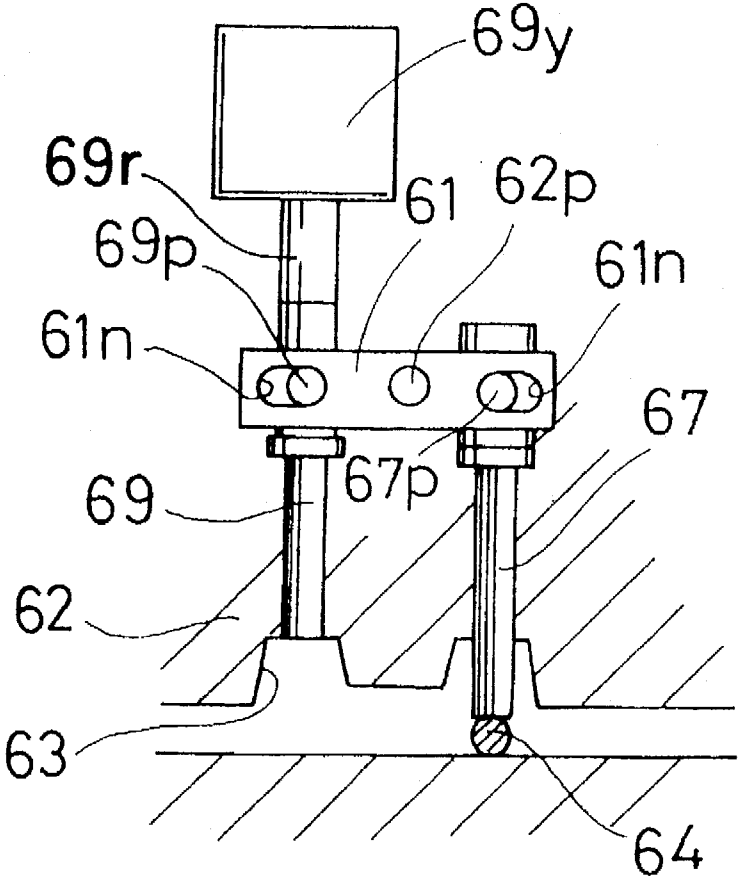

FIGS. 8(A) and 8(B) are sectional views showing pipe casting apparatus according to a sixth embodiment the invention.

In the pipe casting apparatus according to this embodiment, retreat of a counter support pin 67 and advancement of a pressurizing pin 69 are interlocked to each other by a single cylinder 69*y*.

The cylinder 69*y* for operating the counter support pin 67 and the pressurizing pin 69 in an interlocked relation to each other, is mounted in a die 62 of the casting apparatus. The cylinder 69*y* can directly drive the pressurizing pin 69. A link bar 61 is coupled at one end by a pin 69*p* and a slot 61*n* to a piston rod 69*r* of the cylinder 69*y*, and the link bar 61 has a central portion rotatably supported by a pin 62*p* on the die 62, and is coupled at the other end also by a pin 69*p* and a slot 61*n* to a stem portion of the counter support pin 67. With this construction, lowering of the pressurizing pin 69 by the cylinder 69*y* causes rotation of the link bar 61 in the counterclockwise direction as viewed in the drawing about the pin 62*p* to raise the counter support pin 67. Conversely, raising of the pressurizing pin 69 by the cylinder 69*y* causes rotation of the link bar 61 in the clockwise direction as viewed in the drawing to lower the counter support pin 67 into contact with the end of the center pin 64.

In this pipe casting apparatus, by closing the die 62, the center pin 64 for forming the fuel passage wd is positioned with respect to a cavity defining surface. At this time, the counter support pin 67 is brought into contact with a free end portion of the positioned center pin 64 on the side thereof opposite the cavity defining surface noted above, i.e., from above. The free end portion of the center pin 64 is thus supported such that it is clamped radially between the cavity defining surface and the counter support pin 67, as shown in FIG. 8(A).

When the die 62 has been closed in the above way, molten metal is injected from a sleeve (not shown) and poured through a gate into a cavity 63. When a predetermined period of time is passed after the charging of molten metal into the cavity 63, the cylinder 69*y* is moved to lower the pressurizing pin 69. The molten metal is thus locally pressurized. The lowering of the pressurizing pin 69 by the cylinder 69*y* also causes rotation of the link bar 61 in the counterclockwise direction as viewed in the drawing about the pin 62*p* to raise the counter support pin 67 up to the vicinity of the cavity defining surface. With the rising of the counter support pin 67, a space is defined, to which molten metal having been pressurized by the pressurizing pin 69 is supplied.

Thus, in the pipe casting method according to this embodiment, the counter support pin 67 and the pressurizing pin 69 can be operated by a single cylinder 69*y*, so that the equipment cost can be reduced. Simultaneously with the raising of the counter support pin 67, the pressurizing pin 69 is pushed into the cavity 63 to ensure smooth charging of molten metal.

Seventh Embodiment

Figure 9B:
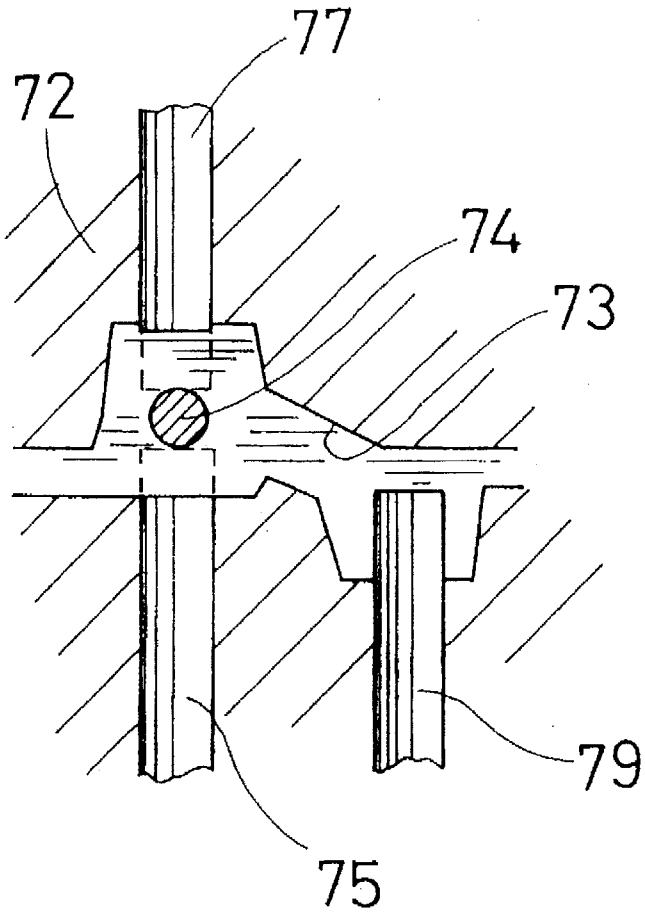
FIGS. 9(A) and 9(B) are fragmentary sectional views showing a pipe casting apparatus according to a seventh embodiment of the invention.
Figure 9A:
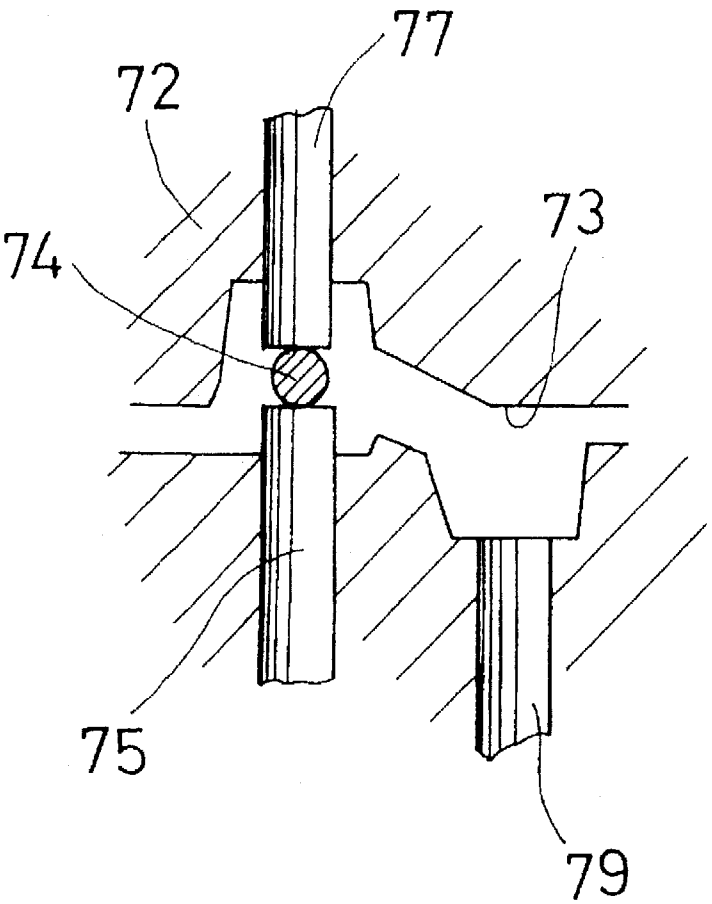
Figure 10B:
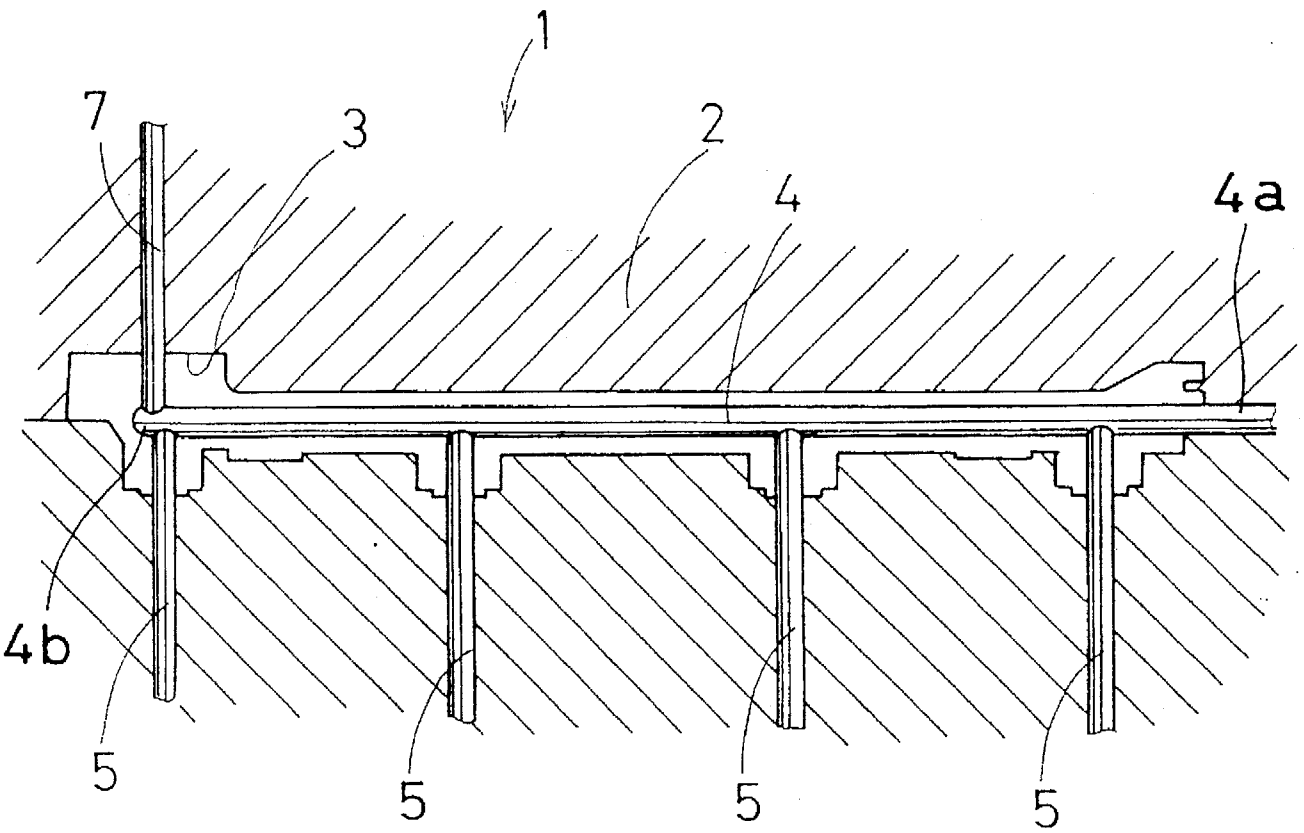
FIGS. 10(A) and 10(B) are sectional views showing a prior art pipe casting apparatus.
Figure 10A:
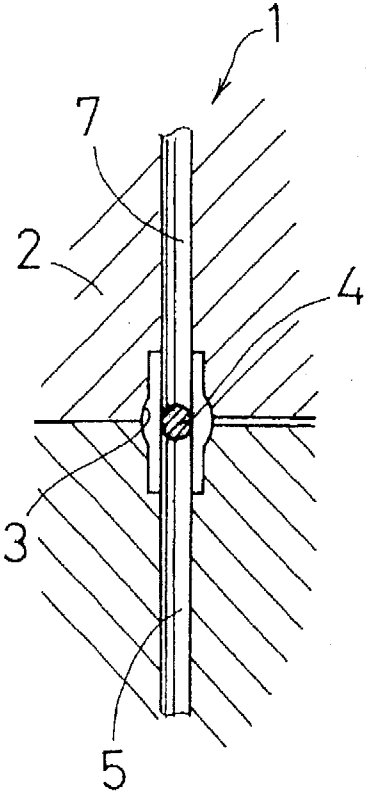

FIGS. 9(A) and 9(B) are sectional views showing a pipe casting apparatus according to a seventh embodiment of the invention.

As shown in FIG. 9(A), in the pipe casting apparatus according to this embodiment, a free end portion of a center pin 74 is held clamped radially by two counter support pins 75 and 77 and, as shown in FIG. 9(B), molten metal can be supplied by a pressurizing pin 79 to spaces formed by the retreat of the counter support pins 75 and 77. The center pin 74 thus can be reliably supported by using the counter support pins 75 and 77 even in the case of a delivery pipe w without any hole crossing an axial blind hole at the closed end thereof. In addition, the spaces formed by the retreat of the counter support pins 75 and 77 can be efficiently replenished with molten metal by the pressurizing pin 79 even in the case where the counter support pins 75 and 77 are spaced apart from the gate by a great distance.

It will be noted that the invention covers the following technical matter as well in addition to the foregoing several embodiments:

(1) A pipe casting method wherein after the replenishment of the space formed by the retreat of the support pin with molten metal, the molten metal is pressurized by the support pin.

Thus, the quality of the locality from which the support pin is retreated is improved.

(2) A pipe casting apparatus wherein a gate is provided near the locality from which the support pin is retreated.

Thus, molten metal is supplied efficiently through the gate to the locality from which the support pin is removed. In addition, the locality from which the support pin is retreated can be reliably replenished with molten metal even when molten metal has been partly solidified near that locality.

(3) A pipe casting method wherein the free end portion of the positioned center pin is supported such that it is clamped radially by a plurality of support pins from the outside.

Thus, the center pin can be reliably supported by using support pins even in the case of a pipe having no hole crossing an axial blind hole at the closed end thereof.

Since it is possible to support the center pin by using support pins even in the case of a pipe having no hole crossing an axial blind hole at the closed end thereof, it is possible to form an axial blind hole of a pipe with high accuracy.

While the invention has been described with reference to preferred embodiments thereof, it is to be understood that modifications or variations may be easily made without departing from the scope of the present invention which is defined by the appended claims.

What is claimed is:

1. A method of casting a pipe having an axially elongate hole of which a front end is closed, comprising the steps of:

positioning a rod-like center pin for forming the hole in a cavity of a die in a predetermined positional relation thereto such that a stem position of the center pin is cantilever supported in the die and a free end of the center pin is found in the cavity;

supporting the positioned center pin sidewise with a support pin to prevent positional deviation of the center pin;

charging molten metal into the die cavity;

retreating the support pin apart from the center pin; and replenishing a space formed by the retreat of the support pin with molten metal.

* * * * *